United States Patent [19]

Menke

[11] Patent Number: 4,995,498

[45] Date of Patent: Feb. 26, 1991

[54] RENTAL AND VENDING MACHINE, PARTICULARLY FOR VIDEO CASSETTES, AND CASSETTE CASE FOR VIDEO CASSETTES

[75] Inventor: Wilhlem Menke, Wiesbaden, Fed. Rep. of Germany

[73] Assignee: NSM Apparatebau GmbH & Co. KG, Bingen, Fed. Rep. of Germany

[21] Appl. No.: 353,670

[22] PCT Filed: Nov. 5, 1987

[86] PCT No.: PCT/DE87/00496

§ 371 Date: May 8, 1989

§ 102(e) Date: May 8, 1989

[87] PCT Pub. No.: WO88/03688

PCT Pub. Date: May 19, 1988

[30] Foreign Application Priority Data

Nov. 6, 1986 [DE] Fed. Rep. of Germany ..... 3637894
Jan. 28, 1987 [DE] Fed. Rep. of Germany ..... 3702407

[51] Int. Cl.[5] ..... G07F 7/08

[52] U.S. Cl. ..... 194/205; 221/DIG. 1; 221/88; 221/133; 414/280; 414/932

[58] Field of Search ..... 194/205, 212; 186/55-57; 221/DIG. 1, 120, 133, 79, 88; 294/116; 901/31, 39; 414/280, 331, 416, 661, 932

[56] References Cited

U.S. PATENT DOCUMENTS

| | | | |
|---|---|---|---|
| 4,519,522 | 5/1985 | McElwee | 414/273 X |
| 4,598,810 | 7/1986 | Shore . | |
| 4,734,005 | 3/1988 | Blumberg | 221/88 X |
| 4,839,505 | 6/1989 | Bradt et al. | 221/88 X |
| 4,858,743 | 8/1989 | Paraskevakos et al. | 194/205 |

FOREIGN PATENT DOCUMENTS

| | | | |
|---|---|---|---|
| 1207411 | 7/1986 | Canada | 194/205 |
| 191636 | 8/1986 | European Pat. Off. . | |
| 3723539 | 1/1989 | Fed. Rep. of Germany | 194/205 |
| 2563985 | 11/1985 | France . | |
| 002758 | 5/1986 | World Int. Prop. O. . | |
| 004173 | 7/1986 | World Int. Prop. O. . | |
| 009460 | 10/1989 | World Int. Prop. O. | 194/205 |

*Primary Examiner*—H. Grant Skaggs
*Assistant Examiner*—Dean A. Reichard
*Attorney, Agent, or Firm*—Spencer & Frank

[57] ABSTRACT

A hiring and vending slot-machine, in particular for video cassettes, has a cupboard-like housing, two superimposed storage compartments arranged within the housing for the boxes containing the video cassettes, a computer-controlled cassette transporting device that can move vertically and horizontally between both compartments, receive and transport the cassette boxes to and from a determined storage container or input-/output shaft in the housing. Reading means read the cassette identification codes and an operating field is provided outside the housing for selecting the desired cassette, requesting or delivering cassette: The operating field has an input keyboard and a display. A cassette transporting carriage (46) can move horizontally or vertically along horizontal or vertical guide-ways in the housing (10) and be shifted into the vertical or horizontal direction within the horizontal or vertical guide-ways. Its driving mechanism can be simultaneously actuated in the horizontal and in the vertical direction, and pull-push means (153) are arranged on the cassette transporting carriage (46) for transporting the cassette box (44) from a storage compartment or an input/output shaft into the cassette-receiving room of the cassette transporting carriage (46) and vice-versa.

22 Claims, 12 Drawing Sheets

RENTAL AND VENDING MACHINE, PARTICULARLY FOR VIDEO CASSETTES, AND CASSETTE CASE FOR VIDEO CASSETTES

BACKGROUND OF THE INVENTION

The invention relates to a rental and vending machine, particularly for video cassettes.

A conventional rental and vending machine, particularly used for video cassettes, including a cabinet-like housing with two oppositely disposed compartmented arrangements for storage of cassette cases containing the video cassettes, a computer controlled cassette transporting device which can be moved vertically and horizontally between the two compartmented arrangements to receive cassette cases and to transport them from and to a certain storage compartment and an inserting/dispensing chute in the housing, a reading device for reading identification codes which characterize the cassettes, and an operating field for selection of the desired cassette and for requesting and loading a cassette, said operating field being attached to the exterior of the housing and including input keys and a display.

Such a machine is described in EP-OS 191,636. This prior art machine includes a robot arrangement which comprises horizontal, vertical and transverse motion axes and corresponding movable elements. Various stepping motors are provided for the movements, each furnishing a drive by means of conveyor belts. To remove a cassette case, a guide path for the carriage moving in the transverse direction is introduced into a section of a compartment containing a cassette case and the guide path is raised vertically until it supports the cassette case. The cassette case is then pulled out of the compartment. The carriage moving in the transverse direction is able to remove cassette cases from both compartmented arrangements. In the prior art machine, the entire removal and supplying process is computer controlled.

DE-OS 3,433,709 discloses a cabinet-like automatic vending machine for rental and sale of videofilm cassettes. The cassettes stored in compartments are pushed by a spring against a wall of the compartment. This spring serves particularly to hold a remaining cassette once a further cassette disposed, in the same compartment has been removed. The cassette cases are here held in an oblique orientation and the cassettes are arranged in a viewing window in such a manner that the title of the cassette shown in the viewing window can be read. However, this arrangement makes it possible only to offer a limited number of cassettes for sale or rental since the viewing surface and thus the number of cassettes displayed on this viewing surface is limited.

In a vending machine disclosed in DE-OS 3,405,042, cassettes or other box-shaped articles such as, for example, video cassettes, are discharged and received. The video cassettes discharged by the prior art machine are coded by means of a bar code so that it is possible to further transport the cassettes by means of this code and to follow their path. In the machine, the cassette cases are arranged in a rack equipped with compartments that slope obliquely forward and downward. The cassettes are each held by a bent arm which releases the cassette by performing a rotary movement so that the cassette then slides off a rail. A tray is provided for return of the cassettes; it receives the cassette cases in a vertically upright position. In this prior art machine as well, the number of stored cassettes is limited due to their relatively large space requirement.

SUMMARY OF THE INVENTION

It is an object of the invention to provide a simply constructed machine having a large cassette storage capacity for rental and sale of video cassettes.

This is accomplished in a machine having a cassette transporting carriage which is movable within the housing along a horizontal or vertical guide and is adjustable in the vertical and horizontal directions together with the horizontal and vertical guides, respectively, with the drive being actuatable simultaneously in the horizontal and in the vertical direction; and a push-pull mechanism provided at the cassette transporting carriage for transporting a cassette case from a storage compartment or from the inserting/dispensing chute, respectively, into the cassette receiving area of the cassette transporting carriage and vice versa.

The machine according to the invention is distinguished by a particularly expedient mechanism for moving the cassette transporting carriage, since the latter can be moved simultaneously in the horizontal and vertical directions, thus significantly shortening the processing time for an individual cassette or cassette case. The cassette transporting carriage is equipped with a push-pull mechanism which is able to place a transported cassette into its associated storage compartment or remove a desired cassette and accommodate it in the cassette transporting carriage. With this structure it is possible to effect the transport of cassettes with only a single carriage and particularly without the use of transverse rails which involve the requirement for much space. In this way, the number of storage compartments in a compartmented arrangement can be increased and simultaneously the spacing between facing compartmented arrangements can be reduced. Thus, the machine can be made more compact while simultaneously having a greater storage capacity. Additionally, vertical and horizontal drives can be designed to have the same locking and unlocking systems for forward and reverse movement so that the cassette cases can be deposited in their respective storage compartments either horizontally or vertically.

In order to be able to process cassette cases from both compartmented arrangements of the housing by means of the cassette transporting carriage, the cassette transporting carriage is preferably equipped with a push-pull mechanism on either side. A particularly advantageous configuration of such a push-pull mechanism is a gripper arrangement whose gripper arm can be moved from a rest position in the cassette transporting carriage in the direction of the respective storage compartment or inserting/dispensing chute and can be brought into engagement with the cassette cases by means of recesses or protuberances. Preferably, each gripper arm is designed as an articulated lever having a cam-like profile against which lies a switch shaft lies which can be displaced by means of a magnet. The switch shaft is able to control the lever in such a manner that, upon removal of a cassette case from a storage compartment or from the inserting/dispensing chute, a pivoting movement causes its recess to engage in a corresponding opening in the cassette case and, for transporting a cassette case to a storage compartment or to the inserting/dispensing chute, its protuberance lies against the frontal face of the cassette case. Such a pivoting and advancing movement can be performed with ease, with the force expended being minimal.

To make access reliable and also be able to accurately determine the travel time, the cassette transporting carriage is locked each time in a position opposite the addressed storage compartment. This is preferred, because, from a new start of carriage movement, the accurate position of the cassette transporting carriage can then always be determined on the basis of the expired time. Displacement during the removal process would result in inaccuracies. However, to permit operation of the machine in the case of current interruptions and the like, one embodiment of the invention provides that, if the cassette transporting carriage is not locked, it by itself can be moved manually in the horizontal direction and the entire horizontal guide arrangement including the cassette transporting carriage can be moved vertically by hand.

A friction wheel arrangement is preferably provided for the forward movement of the cassette transporting carriage.

In a preferred embodiment of the invention, the cassette transporting carriage is provided with a light barrier arrangement in the region where the respective cassette case enters into the transporting area of the carriage. In this way, it is possible to determine the position of a cassette case, that is, how far it has already entered into the transporting area or to what extent it has left it. On the basis of the determined position of the cassette case, the respective push-pull mechanism can then be started up to transport the cassette into the respective storage compartment.

Each of the light barrier arrangements preferably includes a pivot lever whose one end can be deflected by a cassette case disposed in the transporting area, with the other end of the pivot arm being brought out of the light barrier arrangement by such a deflection movement. This type of position determination is particularly simple and reliable. Another advantageous feature of the machine is characterized by the fact that the light barriers are coupled to a motor for driving friction rollers so as to completely insert a cassette case pushed into the transporting area, with the cassette case being held in the middle of the transporting area as soon as both light barriers have responded and thus the motor has been stopped.

A particularly reliable and simply constructed holding arrangement for the cassette cases in the storage compartments results from the fact that, in the rear of each storage compartment, a detent spring arrangement is provided in which a leaf spring is disposed on one side so as to laterally project obliquely into the path of the cassette case and a stop spring is arranged on the other side at the end of the storage compartment. A projection is disposed on the side of the stop spring and can be brought into engagement with an opening in the cassette case. As a further feature of the invention, the storage compartments are each provided with contacts which indicate the occupation state of the storage compartments. In this way there is increased security and redundancy for a determination by computer so that a reliable overview is always provided as to which cassettes are still available.

In a preferred embodiment of the machine according to the invention, the inner end of the inserting/dispensing chute is arranged adjacent to the path of the cassette transporting carriage. In this way, the length of the transporting path for newly introduced cassettes and for dispensing selected cassettes is minimal.

In another embodiment of the machine according to the invention, the inserting/dispensing chute includes a transfer section provided with a forward and a rearward flap. This makes it possible, on the one hand, to accurately localize the cassette and, on the other hand, prevents a second cassette from being pushed in from the outside. Moreover, accurate actuation of a drive mechanism for further transporting the cassette is then also possible. For example, a light barrier arrangement may be provided in the inserting/dispensing chute, the traversal of which actuates a motor drive for the transport of the cassettes toward the cassette transporting carriage. A further advantage of the transfer arrangement is that the inserting/dispensing chute is protected against extraneous influences.

To prevent blockage of the inserting/dispensing chute, a counter may be provided which starts counting when a cassette case is made available for removal and initiates the return transport of the cassette case into its compartment if the cassette has not been removed after a certain period of time.

In order to be able to fully automatize the transporting process, it is advisable to provide a scanning device at the inserting/dispensing opening to read the identification code. The read code is furnished to the computer which then determines the compartment address and actuates the cassette transporting carriage accordingly.

A particularly simple structure for the housing of the machine according to the invention provides that two pivotal doors are provided which are each equipped with a compartmented arrangement for cassette cases. The front door then includes the inserting/dispensing opening. This configuration permits a particularly simple supplying of the compartmented arrangements since no assembly work whatever is now required. Maintenance work is also facilitated considerably. For access to the compartments and to the transporting mechanism it is merely necessary to open a door. Advisably, a third door is attached to the front of the housing. It is configured as an attachable component and is equipped with the operating field. The frontal face of the operating field can preferably be folded away from the third door by way of a hinge. Advisably, the operating field includes a flip card title display with associated viewing screen on which the titles selected from the flip cards can be indicated in synchronism and on which can be displayed an operator's guide, a category selection and a code number selection. This considerably improves accessibility of the individual elements, particularly the flip card title display of the operating field. Moreover, the components can be exchanged more easily and can be adapted faster to changing requirements.

It is also possible to keep the operating field and the inserting/dispensing chute for the cassette cases locked behind a pane of safety glass when the machine is not in use, with, however, the credit card slot being arranged in such a manner that it remains accessible. The safety glass pane is opened automatically only if a permissible credit card has been accepted.

The invention also provides a cassette case which is intended, in particular, to accommodate video cassettes and for use in a machine according to the invention. Such a cassette case is provided with openings at the front and rear of its narrow long sides. The purpose of the openings is here the following. If the cassette case is disposed in a storage compartment, one rear opening is in engagement with a projection in the side wall of the compartment, with a stop spring being disposed in the rear region of this side wall of the compartment and a leaf spring on the opposite side wall of the compartment. If the cassette case is now to be pulled out of the storage compartment, the outer lever of the respective gripper arm of the push-pull mechanism of the cassette transporting carriage is then able to engage in the diagonal opening, which is thus located at the front, pivot the cassette case and then pull it toward the carriage by employing a recess in the gripper arm. If the cassette case is disposed on the opposite side of a compartmented arrangement, the other two, mutually diagonally oppositely disposed openings are utilized.

To enable the machine to read a so-called bar code, that is a code which identifies each individual cassette, the cassette case according to the invention is preferably provided with a longitudinal recess on one of its long narrow sides for accommodating a bar code strip. Advisably an asymmetrically arranged identification carrier is disposed on the cassette case for recognition of the object and of the correct insertion direction, with the inserting/dispensing chute being equipped with an associated object recognition device.

BRIEF DESCRIPTION OF THE DRAWINGS

The invention will now be described in greater detail with reference to preferred embodiments and the drawing figures. The drawing figures depict the following.

DESCRIPTION OF THE PREFERRED EMBODIMENT

Figure 1:
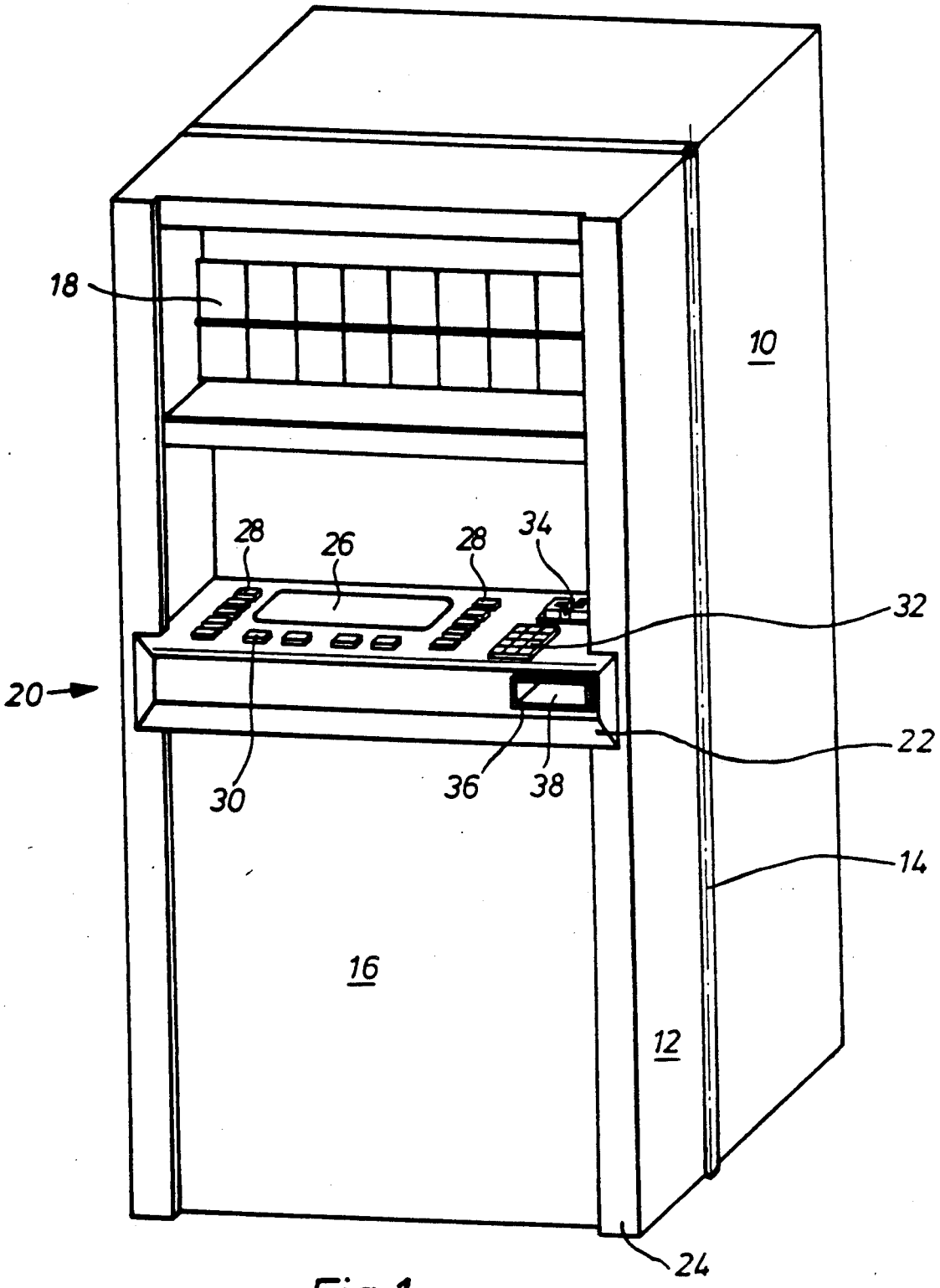
FIG. 1, a perspective view of a rental and vending machine for video cassettes according to the invention.

FIG. 1 depicts a rental and vending machine according to the invention in general. Such machines may be set up, for example, in restaurants, near or in stores. The machine includes a cabinet-like housing 10 and a projection attached in the manner of a pivotal door 12, with the hinge axis being illustrated by a dot-dash line 14. Door 12 includes a lower facing board 16 and an operating field 20 including a recessed flip card title display 18. Operating field 20, which is recessed, rests with a broader lateral section 22 on a lateral facing strip 24 of door 12. The frontal face 23 of operating field 20 can be folded away from door 12 by way of a hinge 25. The operating field is equipped with a viewing screen 26, two rows of function keys 28, four further function keys 30 and a key pad 32. Behind key pad 32, there is disposed a slot 34 to accommodate credit cards and the like. The titles selected from the flip card title display 18 can be displayed simultaneously on viewing screen 26. An operator's guide, a category selection, for example only Western video cassettes, or a code number selection may also be displayed on viewing screen 26.

At the front right of the frontal facing of operating field 20, there is an opening 36 leading to an inserting/dispensing chute 38.

Figure 2:
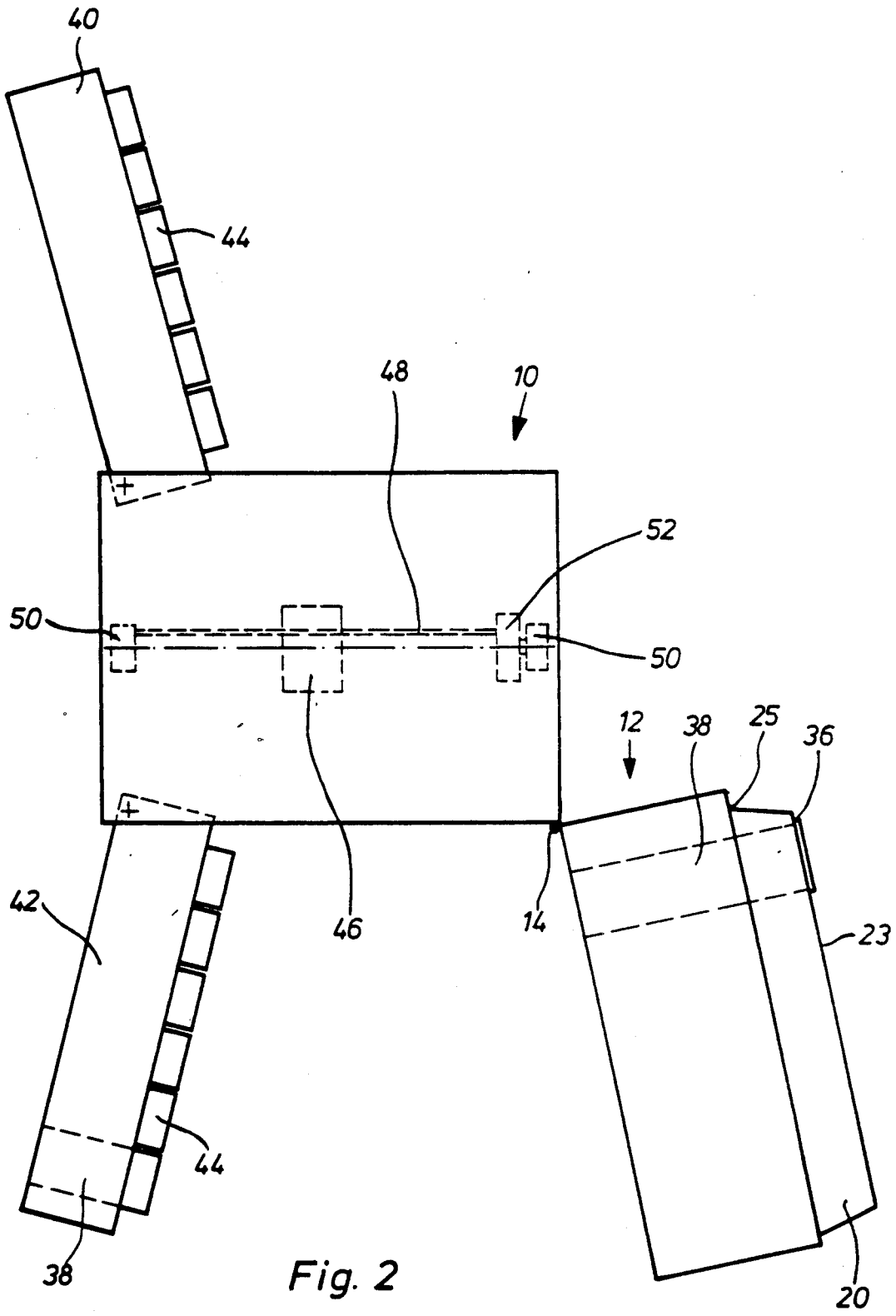
FIG. 2, a top view of the machine shown in FIG. 1, with its doors opened.

FIG. 2 shows the machine illustrated in FIG. 1 in an opened state. In addition to door 12, the machine includes two doors 40 and 42 which can be pivoted into housing 10 and each include the compartmented arrangements. FIG. 2 of the drawings shows cassette cases 44 disposed in compartments of the arrangements. The front pivotal door 42 includes, toward the exterior, part of inserting/dispensing chute 38. If the two doors 40 and 42 are closed, a sort of channel or free space is formed between them in which the cassette transporting device is able to move. This is shown in phantom lines in FIG. 2. A carriage, the so-called x-direction running mechanism (hereinafter, however, called cassette transporting carriage 46) is movable back and forth in the direction of the x axis along toothed rods 48. At both ends, there are vertical toothed rods 50 extending in the y direction. The y-direction running mechanism 52 is disposed closely in front of one of the toothed rods. The y-direction running mechanism moves the x axis together with the x-direction running mechanism. Simultaneous movement of both running mechanisms permits the fastest possible access to a desired cassette or to a target compartment.

Figure 3:
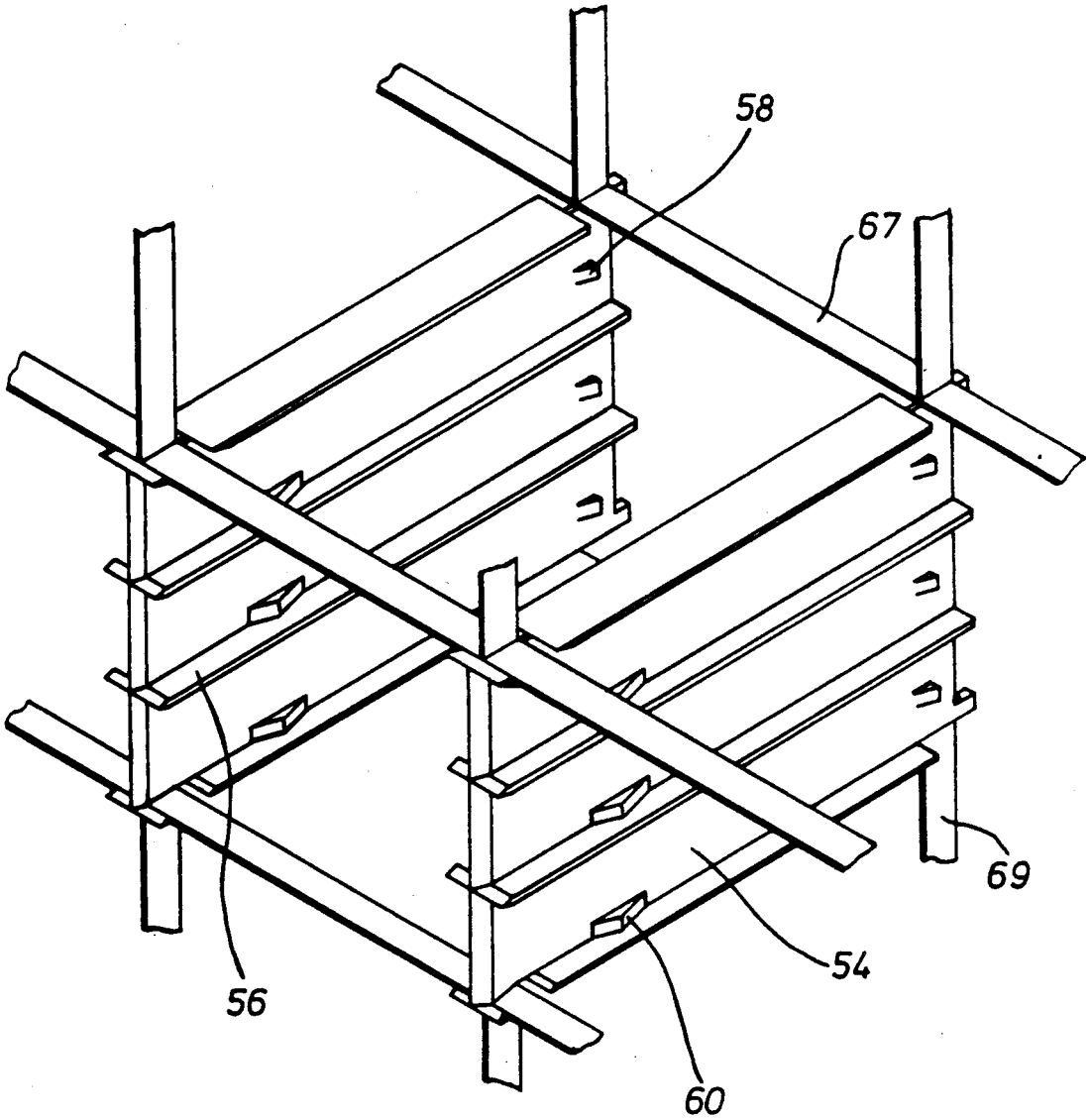
FIG. 3, an illustration of the storage compartment structure.

FIG. 3 depicts a section of a compartmented arrangement. It shows the width of a compartment which, taken six times, results in approximately the width of the door. Two vertical side walls 54 are shown which are each equipped with laterally projecting horizontal ledges 56 on which cassette boxes 44 are displaceable. Three cassettes fit into each one of these compartment subdivisions, with an insertion or storage compartment having an address. FIG. 3 shows the front end of the compartments on the left while the rear end is on the right in the drawing. At their rear ends, the side walls of each storage compartment are provided with obliquely rearward extending projections 58 which come into engagement with corresponding openings in the cassette cases and hold the cassette cases in the storage compartment. Projections 60 having a triangular base face are also shown in the front region. These latter projections serve as abutments for the cassette cases. For removal, the cassette cases are pivoted about projections 60 so as to bring them out of engagement with projections 58.

FIG. 3 also shows holding rods 67 and 69. Other types of holding rods may of course also be employed to construct such a rack for cassette cases.

Figure 4:
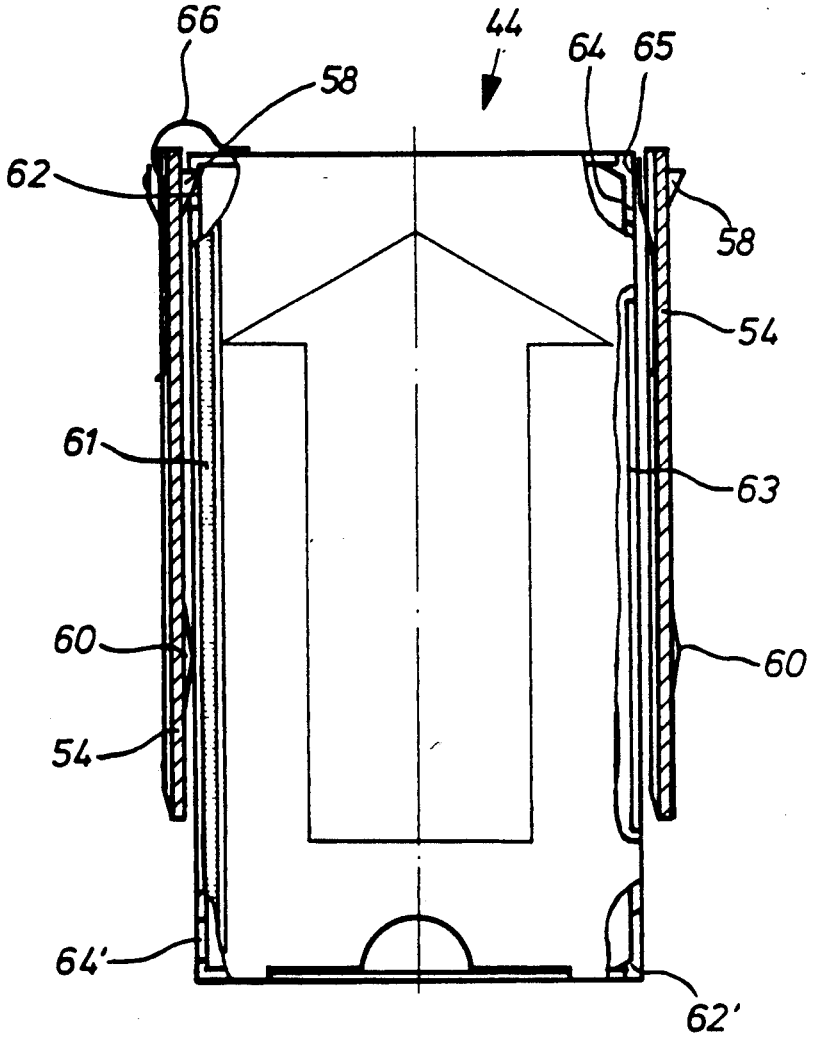
FIG. 4, a sectional view of a storage compartment filled with a cassette, showing the cassette in a top view.

FIG. 4 is a sectional view of a storage compartment with a horizontally inserted cassette case 44 shown in a top view. As already described in connection with FIG. 3, projection 58 engages in the rear opening 62 of cassette case 44 and arrests the cassette case. Additionally, a stop spring 66 and a leaf spring 65 serve as holding means. Stop spring 66 and leaf spring 65 urge the cassette case toward projection 58. Diagonally opposite opening 62, there is a frontal opening 62' in the cassette case. The gripper arm of the push-pull mechanism engages in this opening 62' and pivots the cassette case about projection 60, thereafter pulling it into the x-direction running mechanism, that is cassette transporting carriage 46.

Opening 62 is opposed by an opening 64 and opening 62' is opposed by an opening 64'. Openings 64 and 64' are utilized by oppositely disposed compartmented arrangements.

In the case of vertical insertion of the cassette cases in correspondingly configured storage compartments, the respectively lower rear projection 58 is sufficient to hold the cassette case in its position. For removal of the cassette case from such a storage compartment, the gripper arm of the push-pull mechanism presses on the frontal region of the cassette case which is opposite rear projection 58 and thus, by pivoting it about front projection 60, lifts it out of rear projection 58 of the storage compartment.

Figure 5:
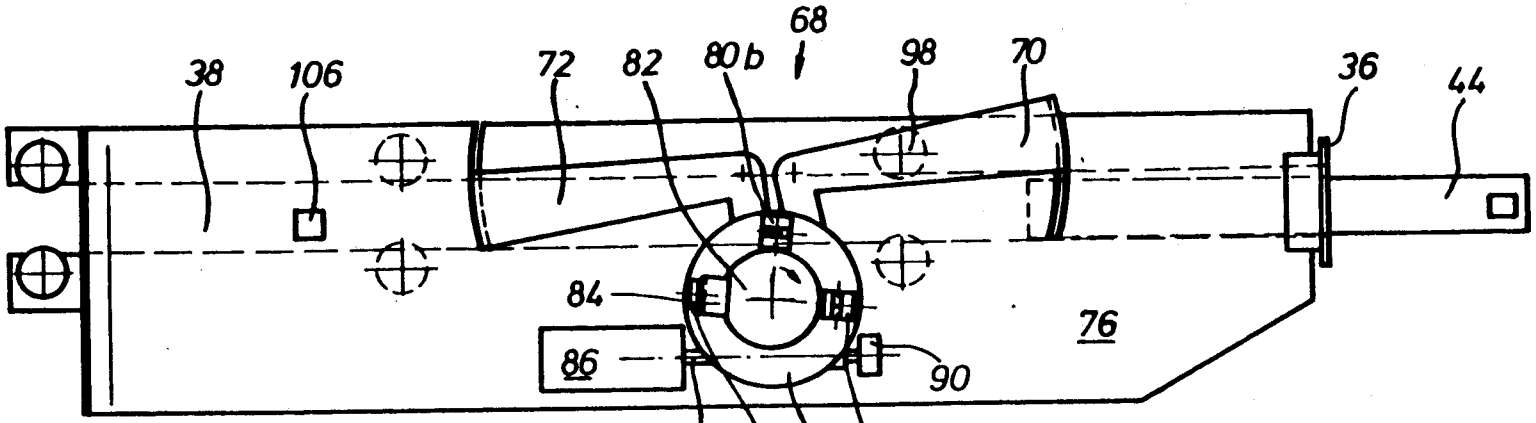
FIG. 5, a side view of part of an inserting/dispensing chute with transfer arrangement according to the invention.
Figure 6:
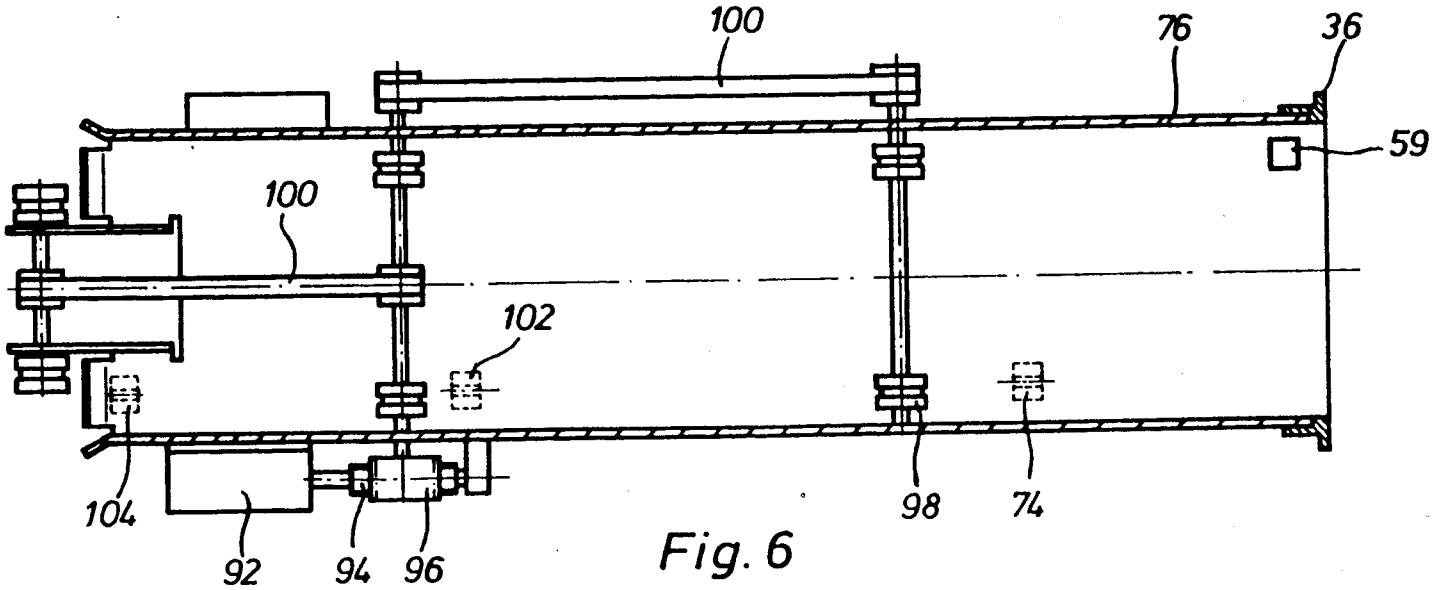
FIG. 6, a bottom view of the part shown in FIG. 5.

FIG. 5 shows part of the inserting/dispensing chute 38 with a cassette case 44 which has been partially inserted from the outside. As shown by the bottom view (see FIG. 6), a light barrier 74 is disposed at the beginning of a transfer arrangement 68 including flaps 70 and 72 approximately at the height of the intake end of the first flap 70. Light barrier 74 is actuated by the passage of cassette case 44 to emit a pulse. Then flap 70 opens to the position illustrated in FIG. 5 which permits insertion of cassette case 44 into transfer arrangement 68. In the illustration of FIG. 5, second flap 72 is closed. Attached to side wall 76 is a fixed disc 78 which carries three light barriers **80*a*, 80*b* and 80*c*. The disc has an opening in its interior within which there is disposed a further rotatable disc 82. On its exterior, disc 82 is provided with a signal generator 84 which successively breaks the light barriers when disc 82 rotates. By means of a shaft (not shown), disc 82** is connected with a cam wheel with which the flaps are coupled for movement.

Beginning with the position of the signal generator shown in FIG. 5, the left flap 72 is opened. If light barrier **80*b* is broken, the right flap is closed while breaking of light barrier 80*c* causes the left flap to be closed. At a position of signal generator 84 between light barriers 80*c* and 80*a*, the right flap 70 is opened again. A motor 86 equipped with a pinion 88 and a bearing 90 is provided to drive disc 82**.

A second motor 92 with pinion 94 and toothed wheel 96 is provided to drive a friction roller arrangement whose friction rollers 98 are coupled by means of toothed belt drives 100.

The sequence of the movements is as follows. Actuation of light barrier 74 by an entering cassette case 44 starts up motors 86 and 92. The actuation of a second light barrier 102 confirms the position of the cassette case in transfer arrangement 68. If light barrier 74 is no longer actuated, motor 86 is turned off. Actuation of a light barrier 104, however, starts up a further, subsequent drive to bring the cassette case out of the inserting/dispensing chute and feed it to the x-direction running mechanism, that is, cassette transporting carriage 46. For this purpose, actuation of the push-pull mechanism of cassette transporting carriage 46 may suffice.

An identification code reader is provided to read the code attached in a longitudinal recess 63 of a long narrow side of the inserted cassette box 44. The scanning beam is directed through a window 106 in side wall 76 onto the cassette case, that is, onto its code strip. By means of the code, the address, that is, the insertion target in the compartmented arrangement, can be determined. An asymmetrically arranged identification carrier 61 is further provided on each cassette case 44 to identify the object and the appropriate insertion direction, with an object recognition device 59 being provided at an appropriate location in inserting/dispensing chute 38.

Figure 7:
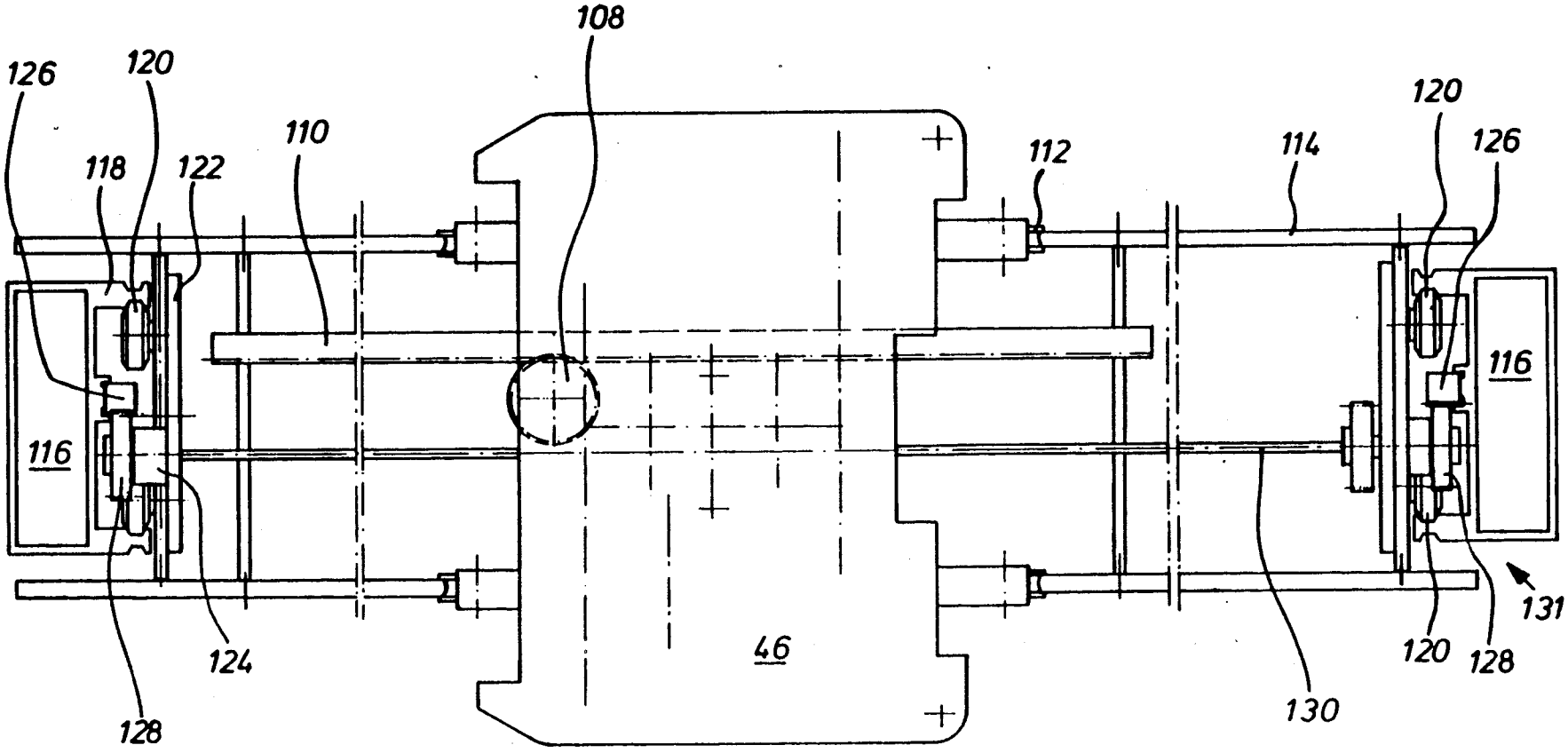
FIG. 7, a top view of a cassette transporting device with guide according to the invention.

FIG. 7 depicts the drive of the x-direction running mechanism, that is, of cassette transporting carriage 46. A toothed wheel 108 and a toothed rod 110 serve to drive the carriage. Rollers 112 serve as guidance along guide rails 114.

At the left end there is a vertical chute 116 which is provided for a counterweight. It includes lateral flanges 118 oriented toward toothed rod 110, with guide rollers 120 for movement in the y direction running in recesses in these flanges. A motor 124 seated on a vertical mount 122 actuates a toothed wheel 128 running along a toothed rod 126. A slaving rod 130 serves to symmetrically guide the x-bearing and is mounted at its other end in a vertical guide 131 of analogous configuration.

Figure 8:
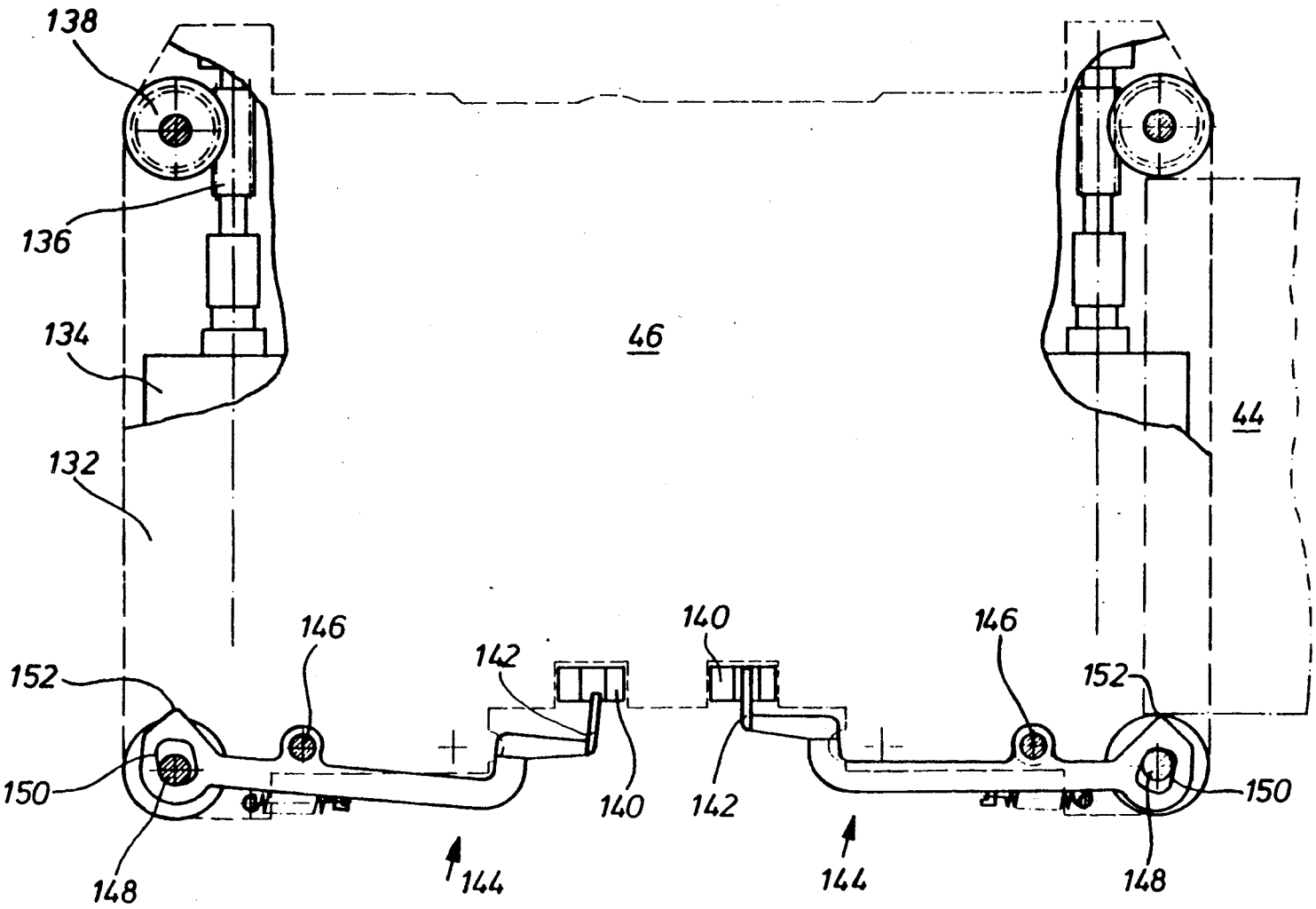
FIG. 8, a bottom view of the cassette transporting device in a partially broken-away illustration.

FIG. 8 shows cassette transporting carriage 46 in a bottom view. The lower plate 132 is shown partially broken away, thus revealing a motor 134 which drives friction rollers 138 by means of a pinion 136. Motor 134 is actuatable by means of light barriers 140. It is turned on if an interrupter arm 142 breaks the light barrier. Interrupter arms 142 are each bent arms of a lever arm arrangement 144 which is pivotal about an axis 146. At its end opposite interrupter arm 142, the lever arm is provided with a long hole type hole 150 which can be adjusted along a pin 148. The end of the lever arm surrounding long hole 150 has a projection 152. If a force is exerted from the interior onto projection 152, the end of the lever arm is displaced outwardly on the long hole guide, causes lever arm arrangement 144 to be pivoted and interrupts the light barrier as is the case on the left in FIG. 8, due to the insertion of a cassette case 44. Motor 138 is then started up and moves a cassette case inserted into the transporting area fully into it. The motor drive is stopped if the second light barrier is also actuated. Thus cassette case 44 is held in the middle of the transporting area of cassette transporting carriage 46.

Figure 9:
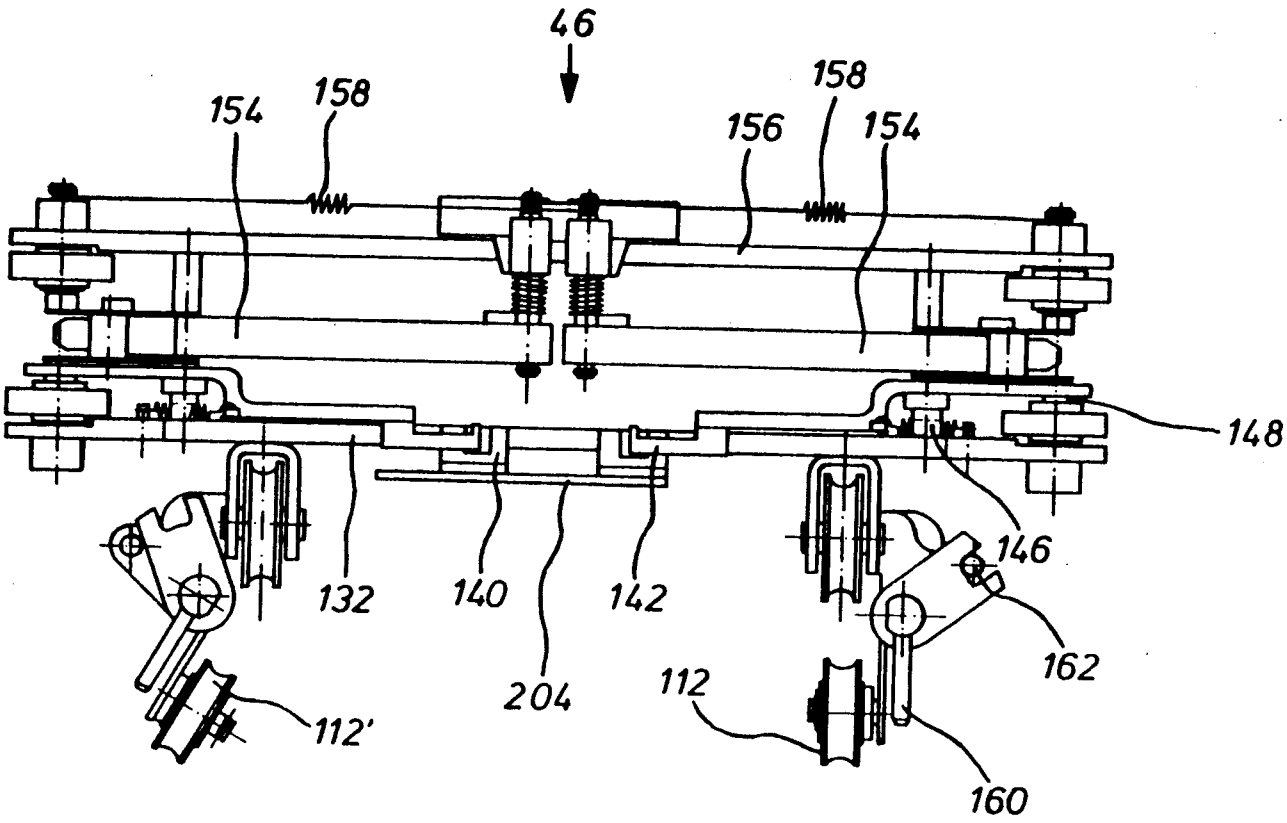
FIG. 9, a side view of the cassette transporting carriage.
Figure 11:
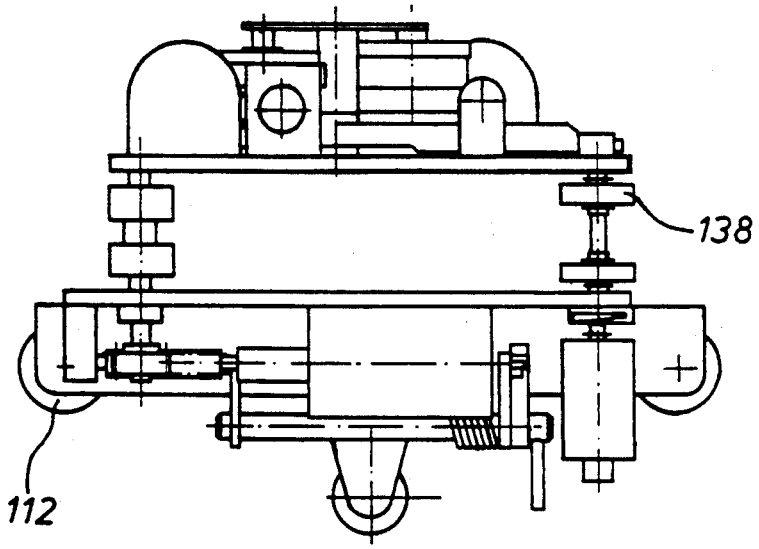
FIG. 11, a side view of the cassette transporting carriage shown in FIG. 10.

FIG. 9 shows cassette transporting carriage 46 from the side, that is, seen from the top in FIG. 8. Between lower plate 132 and an upper plate 156, pivotal gripper arms 154 are arranged whose function will be described below. Also shown are reset springs 158. FIG. 9 also depicts the movement of the lower rollers 112 by means of an adjustment lever 160. Pivoting of adjustment lever 160 toward the outside causes a tongue to be pivoted beyond a pin 162 so that roller 112' is stably held in the pivoted position. Such a function for assembly of the carriage is expedient. Further components which have already been described bear the same reference numerals.

Figures 12, 13:
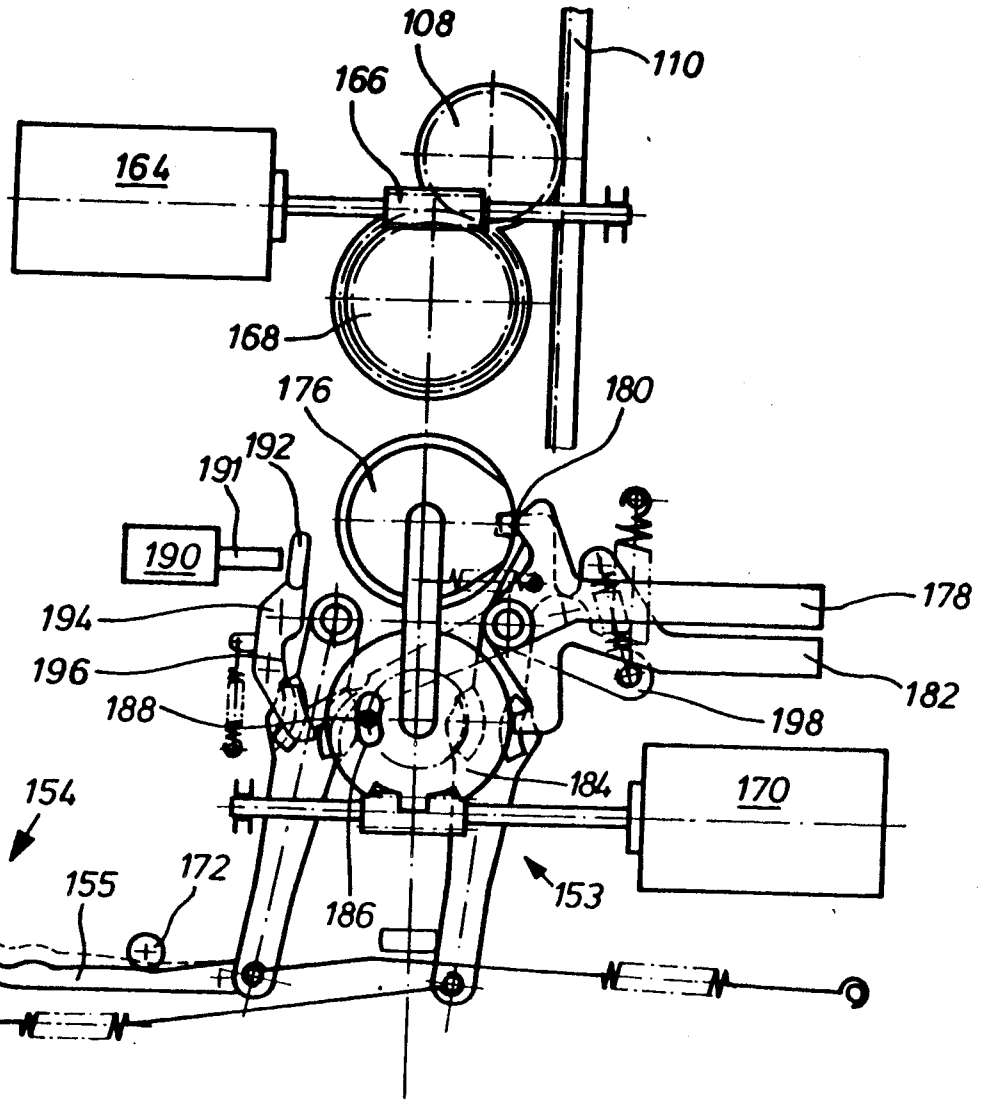
FIGS. 12 and 13, enlarged views of the mechanism shown in FIG. 10.

FIG. 13 depicts a motor 164 as well as a pinion 166 and two toothed rods 108 and 168. Toothed rod 108 is in engagement with toothed rod 110. Motor 164 serves to drive the carriage in the x direction.

Figure 10:
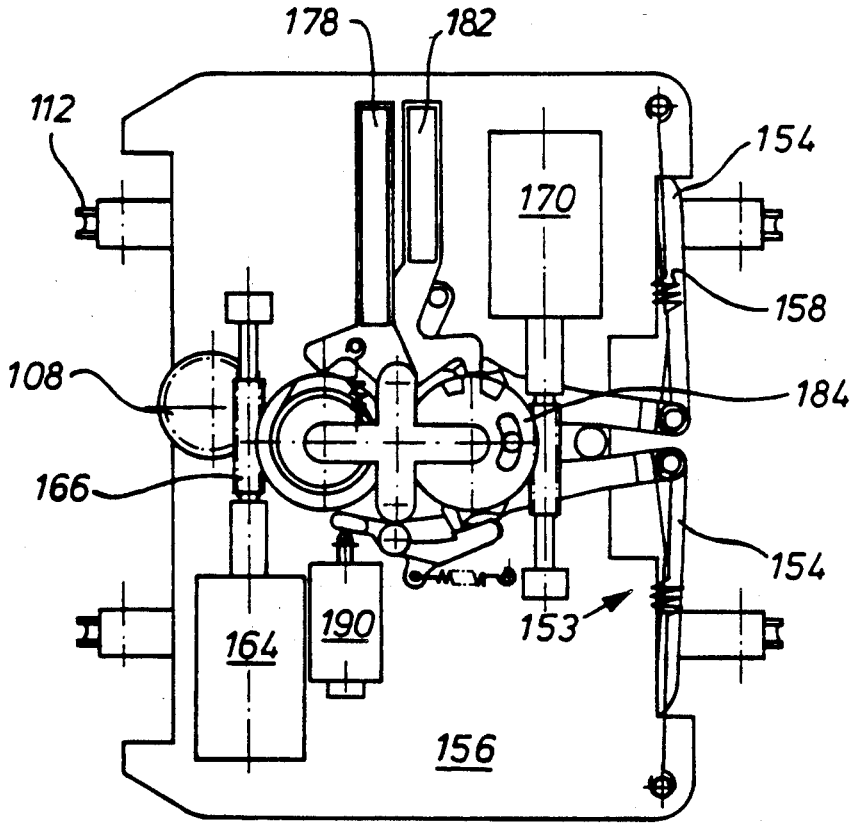
FIG. 10, a top view of the cassette transporting carriage, with the cover plate omitted.

FIG. 12 is an enlarged partial view of FIG. 10 and depicts the cassette transfer mechanism between storage compartment and cassette transporting carriage. The gripper arrangement is illustrated. A motor 170 is provided to drive and actuate gripper arms 154 and to lock them. The articulatedly attached outer lever 155 of gripper arms 154 is configured to have a cam like profile and lies against a switch shaft 172 which controls the movement of the gripper arm or, more precisely, the movement of its outer lever. Outer lever 155 is configured to include a protuberance 173 and a recess 174. Two further positions of outer lever 155 are shown in dashed lines. Between plates 156 and 132, a guide channel is provided for the gripper arms. By means of a return spring 158, the extended gripper arms are brought back into their rest position.

The structure provided for a change of cassettes will now be described in greater detail, initially with reference to FIG. 12. A counting cam 176 is in engagement with a counting lever 178 whose projection goes into engagement with the cam of the counting cam. Adjacent to the counting lever and arranged to be linked with it is a positioning lever 182. The latter can be brought into engagement with a slide disc 184 which is provided with a curved slot 186 coupled to a pin 188. A light barrier arrangement (not shown) is provided to monitor and determine the position of levers 178 and 182.

A magnet 190 can be brought into engagement by way of a pin 191 with one end 192 of a pivot lever 194. On its side facing away from magnet 190, lever 194 is given a recess 196 into which a clamping lever 198 is able to engage, thus tensioning the lever in that position and placing it against pin 188.

The carriage is in its rest position if motor 164 is locked by a tongue of positioning lever 182. This is the position in which cassette cases can be removed or returned. The change of cassettes takes place as follows: With slide disc 184 released, gripper motor 170 turns the worm gear and the slide disc, thus actuating gripper arm 154. Depending on the selected compartmented arrangement, the right gripper arm or the left gripper arm is actuated. By means of switch shaft 172 which can be moved by means of magnet 200, the gripper lever is pivoted inwardly (dashed illustration) and pushed into or pulled out of the compartment. One-half of a revolution tensions clamping lever 198 and gripper arm 154 is back in its rest position.

In the last quarter, pin 188 passes through the radial slot in the gripper arm in that the worm gear is shunted in the axial direction and drops back due to the spring force exerted on it. Positioning lever 182 drops into the rocker lever and releases counting cam 176. A light barrier turns off gripper motor 170 and turns on drive motor 164. The gripper motor runs down in the radial slot.

Figure 14:
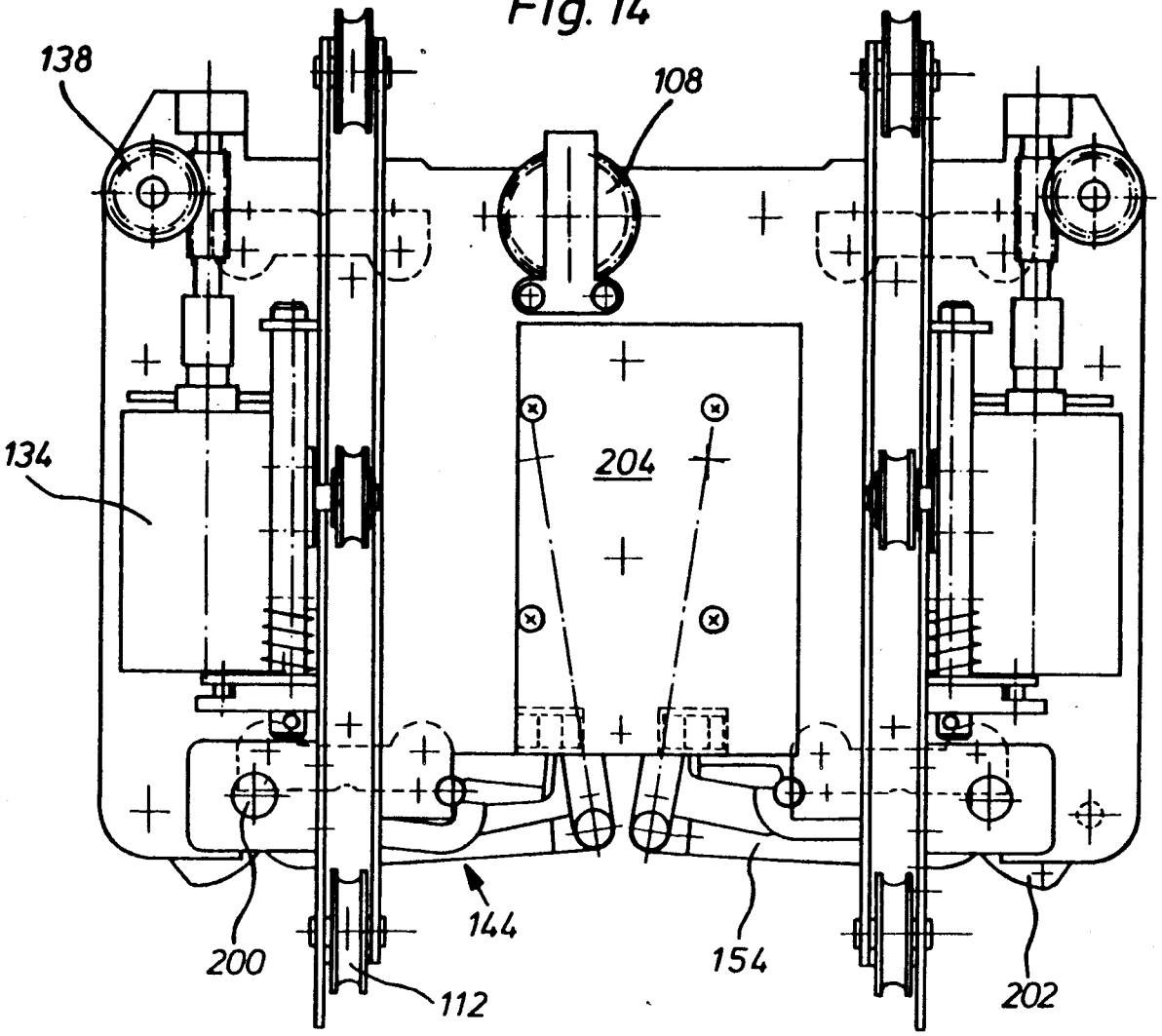
FIG. 14, a bottom view of the cassette transporting device.

FIG. 14 is a bottom view of cassette transporting carriage 46. The same components are given the same reference numerals as in the other figures. A displacement magnet 200 serves to move the switch shaft of the gripper levers. A guide 202 is provided for the gripper levers. Moreover, a bed plate 204 is fastened to the bottom of the carriage and accommodates electronic circuit components.

Figure 15:
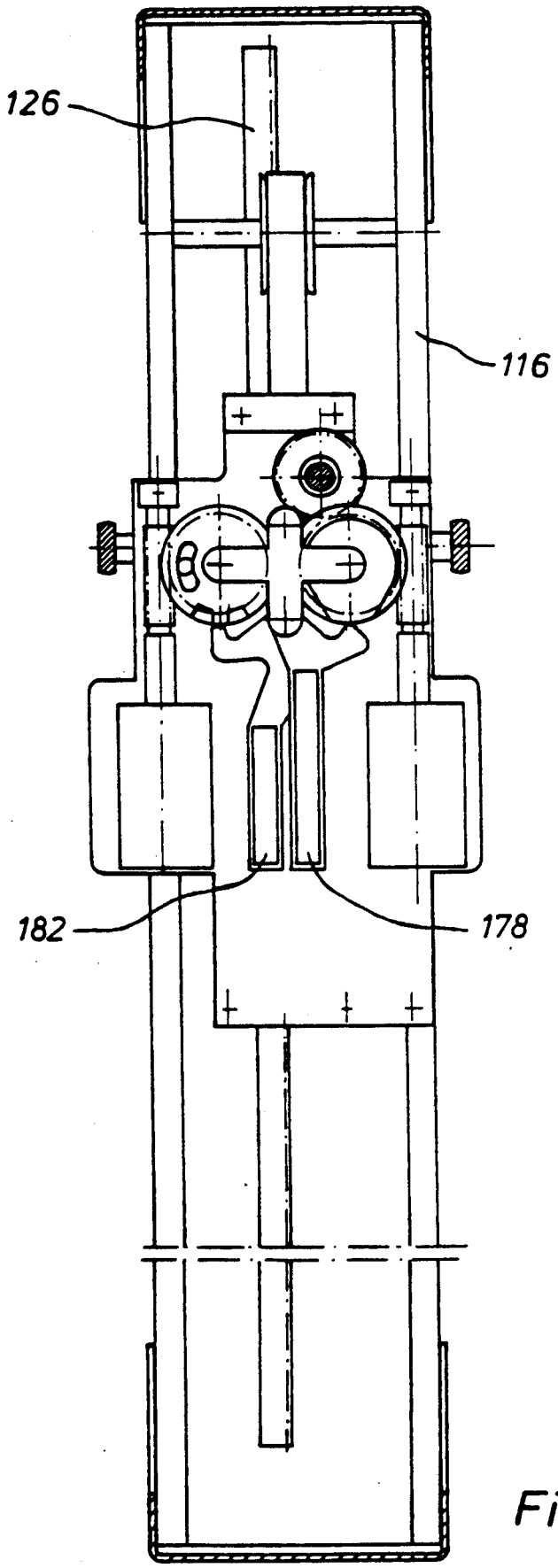
FIG. 15, a side view of a vertical displacement device according to the invention.

In FIG. 15, chute 116 is shown in greater detail. The mechanism for displacement in the y direction is essentially the same as for the x direction so that these components correspond to one another (compare, in particular, FIG. 12). They will therefore not be described again, rather reference is made to the description of FIGS. 7 and 10 to 13.

I claim:

1. Rental and vending machine, particularly for video cassettes, the machine comprising: a cabinet-like housing, two oppositely disposed compartmented arrangements accommodated in the housing for storage of cassette cases containing the video cassettes; a computer controlled cassette transporting device including a horizontal guide and a vertical guide with associated drive motors along which the device can be moved between the two compartmented arrangements to receive cassette cases and to transport them from and to a certain storage compartment and an inserting/dispensing chute, respectively, in the housing; a reading device for reading identification codes which characterize the cassettes; an operating field for selection of the desired cassette and for requesting and loading a cassette, said operating field being attached to the exterior of the housing and including input keys and a display; a cassette transporting carriage which is movable within the housing together with the horizontal or vertical guide and is adjustable in the vertical and horizontal directions with the drive motors being actuable simultaneously in the horizontal and in the vertical directions; and two push-pull mechanisms comprising gripper arms provided opposite one another at the cassette transporting carriage for transporting a cassette case from a storage compartment or from the inserting/dispensing chute, respectively, into the cassette receiving area of the cassette transporting carriage and vice versa, said gripper arms being movable from a rest position in the cassette transporting carriage in the direction of the respective storage compartment or inserting/dispensing chute, respectively, wherein the two opposing push-pull mechanisms are attached to the cassette transporting carriage so as to face one another and each gripper arm is configured as an articulated lever having a cam-like profile with a recess and a protuberance, sam cam-like profile being contacted by a switch shaft to control said lever so that, if a cassette case is taken from a storage compartment or from the inserting/dispensing chute, a pivoting movement cases one of its recesses to engage in a corresponding opening in the cassette case and, if a cassette case is transported into a storage compartment or to the inserting/dispensing chute, a protuberance on said lever lies against the frontal face of the cassette case.

2. Machine according to claim 1, wherein the cassette transporting carriage can be locked in a position opposite an addressed storage compartment.

3. Machine according claim 1, wherein, if the cassette transporting carriage is not locked, said carriage itself can be displaced manually in the horizontal direction and the entire horizontal guide arrangement including the cassette transporting carriage can be displaced manually in the vertical direction.

4. Machine according to claim 1, wherein a friction wheel arrangement is provided for the forward movement of the cassette cases.

5. Machine according to claim 1, wherein the cassette transporting carriage includes a light barrier arrangement in the region where the respective cassette case enters into the transporting area.

6. Machine according to claim 5, wherein each light barrier arrangement includes a pivot lever whose one end can be deflected by a cassette case disposed in the transporting area, with the other end of said pivot lever being brought out of the light barrier arrangement by means of such a deflective movement.

7. Machine according to claim 5, further comprising a motor for driving friction rollers for the complete insertion of a cassette case pushed into the transporting area, the motor being coupled with the light barriers so that when the cassette box is held in the middle of the transporting area and both light barriers have responded, the motor is stopped.

8. Machine according to claim 1, further comprising a detent spring arrangement disposed in the rear of the storage compartments, the spring arrangement including a leaf spring disposed on one side of a storage compartment, and laterally and obliquely projects into the path of an inserted cassette case; and a stop spring disposed on the other side at the end of the storage compartment, with a projection being provided on the side of the stop spring so as to be brought into engagement with an opening in an inserted cassette case.

9. Machine according to claim 1, wherein each storage compartment is provided with contacts which indicate the occupation state of the compartments.

10. Machine according to claim 1, wherein the inner end of the inserting/dispensing chute is arrangement adjacent to the path of the cassette transporting carriage.

11. Machine according to claim 10, wherein the inserting/dispensing chute includes a transfer section which is provided with a front and a rear flap.

12. Machine according to claim 10, wherein a light barrier arrangement is provided in the inserting/dispensing chute, the traversal of which starts a motor drive for the transport of a cassettes to the cassette transporting carriage.

13. Machine according to claim 1, further comprising a counter which begins counting at the moment a cassette case is made available for removal from the inserting/dispensing chute, wherein after a given count is exceeded, the cassette case is transported back into its compartment.

14. Machine according to claim 1, wherein a scanning device is provided at the inserting/dispensing opening to read the identification code.

15. Machine according to claim 1, wherein the housing includes two pivotal doors, each provided with a compartmented arrangement for cassette cases, with the front door including the inserting/dispensing opening.

16. Machine according to claim 15, further comprising a third door disposed on the front of the housing, said third door being configured as an attachable component and including the operating field.

17. Machine according to claim 16, wherein the frontal face of the operating field can be flipped away from the third door by way of a hinge.

18. Machine according to claim 16, wherein the operating field includes a flip card title display with an associated viewing screen on which the titles selected from the flip card title display can be indicated in synchronism and which provides a display of an operator's guide, a category selection and a code number selection.

19. Machine according to claim 1, wherein if the machine is not in use, the operating field and the inserting/dispensing chute are secured by means of a safety glass pane guided in the housing.

20. A machine according to claim 19, further comprising an object recognition system and wherein each cassette case includes an asymmetrically arranged identification carrier for the purpose of recognizing the object and the correct insertion direction, with the corresponding object recognition system being associated with the inserting/dispensing chute.

21. Cassette case, particularly for a video cassette and for use in a machine according to claim 1, comprising a rectangularly shaped box with two long narrow sides and openings provided at the front and rear of the long narrow sides.

22. Cassette case according to claim 21, further comprising a longitudinal recess on one of the narrow long sides for the application of an identification code strip.

* * * * *